US007117941B1

(12) United States Patent
Gano et al.

(10) Patent No.: US 7,117,941 B1
(45) Date of Patent: Oct. 10, 2006

(54) VARIABLE DIAMETER EXPANSION TOOL AND EXPANSION METHODS

(75) Inventors: John C. Gano, Carrollton, TX (US); Tance Jackson, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/103,327

(22) Filed: Apr. 11, 2005

(51) Int. Cl.
*E21B 23/01* (2006.01)

(52) U.S. Cl. ..... 166/207; 166/118; 166/217

(58) Field of Classification Search ..... None
See application file for complete search history.

(56) References Cited

U.S. PATENT DOCUMENTS

| | | | | |
|---|---|---|---|---|
| 1,880,216 | A | 10/1932 | Simmons | |
| 3,785,193 | A | 1/1974 | Kinley et al. | |
| 4,451,047 | A | 5/1984 | Herd et al. | |
| 5,327,964 | A | 7/1994 | O'Donnell et al. | |
| 6,012,526 | A | 1/2000 | Jennings et al. | |
| 6,029,748 | A | 2/2000 | Forsyth et al. | |
| 6,098,717 | A | 8/2000 | Bailey et al. | |
| 6,112,818 | A | 9/2000 | Campbell | |
| 6,142,230 | A | 11/2000 | Smalley et al. | |
| 6,688,397 | B1 | 2/2004 | McClurkin et al. | |
| 6,702,030 | B1 * | 3/2004 | Simpson | 166/380 |
| 6,722,427 | B1 | 4/2004 | Gano | |
| 6,854,522 | B1 | 2/2005 | Brezinski | |
| 2003/0150608 | A1 | 8/2003 | Smith | |
| 2004/0045720 | A1 | 3/2004 | Duggan | |
| 2004/0168796 | A1 | 9/2004 | Baugh | |
| 2005/0016738 | A1 | 1/2005 | Metcalf et al. | |
| 2005/0056433 | A1 * | 3/2005 | Ring et al. | 166/384 |
| 2005/0072569 | A1 | 4/2005 | Johnston et al. | |
| 2005/0103502 | A1 | 5/2005 | Watson et al. | |
| 2005/0173129 | A1 | 8/2005 | Oosterling | |
| 2005/0230104 | A1 | 10/2005 | Cook et al. | |

FOREIGN PATENT DOCUMENTS

| | | |
|---|---|---|
| GB | 2 414 500 | 11/2005 |
| WO | WO 2004/083591 | 9/2004 |

* cited by examiner

*Primary Examiner*—Zakiya W. Bates
(74) *Attorney, Agent, or Firm*—John F. Booth

(57) ABSTRACT

The present inventions relate to improved apparatus and methods for radially expanding tubulars, such as tubing, casing and sand-control screen assemblies in a subterranean oil or gas well, and more specifically, to a variable diameter expansion tool for expanding downhole tubulars to varying diameters. In general, the inventions provide apparatus and methods for radially expanding a tubular, such as pipe, tubing, screen or screen assembly, deployed in a subterranean well by moving an expansion tool axially through the well. An automatically infinitely variable-diameter expansion cone tool is provided. A variable-diameter cone is provided, movable between an expanded position and a retracted position. The cone is enlarged to its expanded position and advanced through expandable components until a restriction is reached. At the restriction, the variable-diameter cone automatically retracts enough to allow the tool to continue advancing through the wellbore. When the restriction is past, the variable-diameter cone enlarges again to its expanded position.

21 Claims, 8 Drawing Sheets

54
120
122
140
130
144
138
75
144
140
134
132
136
148
190
124
126
128
F
F
F
104
154
150
154
156
182
188
146
142

VARIABLE DIAMETER EXPANSION TOOL AND EXPANSION METHODS

CROSS-REFERENCE TO RELATED APPLICATIONS

None

STATEMENT REGARDING FEDERALLY SPONSORED RESEARCH OR DEVELOPMENT

None

REFERENCE TO MICROFICHE APPENDIX

Not applicable

TECHNICAL FIELD

The present inventions relate to improved apparatus and methods for radially expanding tubulars, such as tubing, casing and sand-control screen assemblies in a subterranean oil or gas well, and more specifically, to a variable diameter expansion tool for expanding downhole tubulars to varying diameters.

BACKGROUND OF THE INVENTIONS

It is common in modern oil field operations and completions to place expandable tubular components 2 downhole in a subterranean well 20, such as that seen in FIG. 1. The expandable components 2 include expandable tubulars and expandable devices which are placed downhole and, once in place, expanded to a desired size. The expandable components can be casing 4, tubing 6, sand-control screen assemblies 8 and other expandable tubulars known in the art. The tubulars can be perforated, slotted or blank (un-slotted) smooth bore. Expandable sand-control screens can include base pipes or other support tubulars. The expandable tubulars can be used to provide mechanical support to the borehole 21 wall to prevent cave-ins or collapses. Multiple layers of expandable tubulars can be employed in a single borehole section. For example, an expandable sand-control screen assembly 8 can be expanded inside an already-expanded casing 4. The expandable tubulars and devices can be employed in cased 4 or uncased 12 wellbores. Additionally, expandable devices, such as seals, annular barriers 31, hangers, packers 32 and other tools as are known in the art, may be employed, either alone or in conjunction with each other and other expandable components. Other tools, such as hangers, packers, barriers, valves, etc., which are not designed to be expanded, may be employed. Other examples will be apparent to those skilled in the art.

It is also common in modern wells to have a multi-zone completion, that is, an oil, gas or combination well 20 which passes through a number of zones, some of which are of interest and others of which are not. Production zones 22 can be separated by non-production zones 23, from which flow is not desired or which should be isolated. The production zones 22 are completed with one or more tubulars which preferably allow flow between the borehole or subterranean zone and the interior of the tubulars. Such tubulars include perforated casing, slotted tubing and sand screen assemblies. The casing may be pre-perforated or perforated in place and is typically cemented in place. The non-production zones 23 are completed with tubulars which do not allow such flow, such as blank or smooth bore casing or tubing 28. Consequently, a single borehole may have alternating areas of production and non-production tubulars. The zones of production 22 are often isolated from the non-production zones 23 by isolation tools or barriers 30 such as are known in the industry, including annular barriers 31, packers 32, seal assemblies and other known devices.

In any completion, but particularly in such multi-zone completions, lengths of tubulars to be expanded may be separated by lengths of tubulars which are not to be expanded. Further, completions may employ seal bores or fixed diameter tubular sections, such as for installation of isolation devices. There may also be other areas along the wellbore which do not readily expand, are designed not to expand or will not expand to the same inner diameter as other sections of tubulars, such as at areas where the borehole is narrow or has collapsed and will not readily allow for expansion, at joints where tubular sections are joined together, at seal bores, where selected isolation devices are deployed, at annular barrier tools, blank pipe, smooth bore pipe sections, restrictions, swollen or narrow borehole areas, where debris, junk or trash is encountered or any other area or section which will not or is not designed to expand, readily expand or expand to the same degree as other tubular sections. These areas, restrictions or "upsets" can include areas which will expand to some degree, but, by design or due to factors beyond the control of the operator, will not readily expand to the same degree as other areas of the expandable tubulars. In such a case, it is desirable to expand the area to an inner diameter greater than its original diameter, but to a size smaller than the expanded inner diameter of the fully expandable sections of tubulars.

Radially expandable components are typically expanded by drawing a mechanical expansion tool through the tubular. The mechanical expansion tool can be pushed or pulled through the component; that is, the component can be expanded from the top downward or from the bottom upward. There are several problems attendant with the apparatus and methods known in the art. Expansion tools are typically in the form of a rigid mandrel introduced into the component to be expanded. The mandrel is dragged or pushed through the component, causing radial expansion by the application of brute force. The expansion cone or tool may have a run-in position, in which the cone is collapsed or retracted to a smaller size to allow passage through the as yet unexpanded components, and then enlarged to a run position to facilitate expansion of the components as the tool is dragged through the components.

Many expansion tools known in the art are of a fixed diameter or are designed to have a single expanded diameter for use in expansion. Commonly, the fixed-diameter expansion tool is introduced into the wellbore and positioned downhole, below the targeted production zone of the formation. The expandable component is then positioned adjacent to the targeted production zone, above the expansion tool, which is then drawn through the component to cause radial expansion. In such an operation, the fixed diameter of the expansion tool is required to be approximately equal to the desired size of the expanded tubular or device. This requirement often presents difficulties in positioning the tool. Some radially expandable expansion tools, known in the art, are designed for introduction into the wellbore in a contracted state, then expanded for use. However, these attempted solutions are not satisfactory for use along component sections having restrictions, upsets, seal bores, blank tubular sections or other areas designed not to expand or which will not expand completely. There is therefore a need for a new expansion tool improving upon the art.

Further problems characteristic of downhole tubular expansion known in the art include tearing of the tubular from over-expansion, under-expansion resulting in lack of contact between the expanded tubular and the wall of the borehole and/or packing materials, and the expansion tool becoming lodged in the borehole. Thus, there is a need for expansion tools and methods providing adjustable expansion capabilities according to downhole conditions.

Further, expansion tools which are available in the industry which can be contracted to a smaller diameter often require a connection to the surface such that the tool can be expanded or contracted manually at the surface by the operator. That is, prior art expansion tools do not automatically respond to downhole conditions to retract from their expanded position to a smaller diameter to pass fixed inner diameter pipe of other restrictions or upsets. Downhole tubular expansion systems known in the art often require one or more surface connections to facilitate powering or controlling expansion apparatus or methods. Surface connections often pose problems associated with the need to pass restrictions in borehole diameter. There is therefore a need for downhole expansion tools and methods which automatically respond to downhole conditions.

SUMMARY OF THE INVENTIONS

In general, the inventions provide apparatus and methods for radially expanding a tubular, such as pipe, tubing, screen or screen assembly, deployed in a subterranean well by moving an expansion tool axially through the well. According to the invention, an automatically infinitely variable-diameter expansion cone tool is provided. A variable-diameter cone is provided, movable between an expanded position and a retracted position. The cone is enlarged to its expanded position and advanced through expandable components until a restriction is reached. At the restriction, the variable-diameter cone automatically retracts enough to allow the tool to continue advancing through the wellbore. When the restriction is past, the variable-diameter cone enlarges again to its expanded position.

The tool is operated using fluid flow pumped, preferably from the surface of the well. The fluid flow is used to operate a stroking piston assembly to advance the expansion tool. A portion of the flow is used to operate the variable-diameter expansion cone tool. The flow is split at a control valve and a pressure drop is created across an orifice. The fluid flow split to a piston assembly operates to move the pistons, which in turn move a wedge which expands the variable-diameter cone. When a restriction is encountered, the tool assembly slows and/or stops, thereby increasing fluid pressure across the control valve. The biased valve closes at a pre-determined pressure and cuts flow to the piston assembly of the cone. The variable-diameter cone retracts until forward motion is achieved. Once motion resumes, the pressure across the control valve drops and pressure is restored to the cone pistons.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
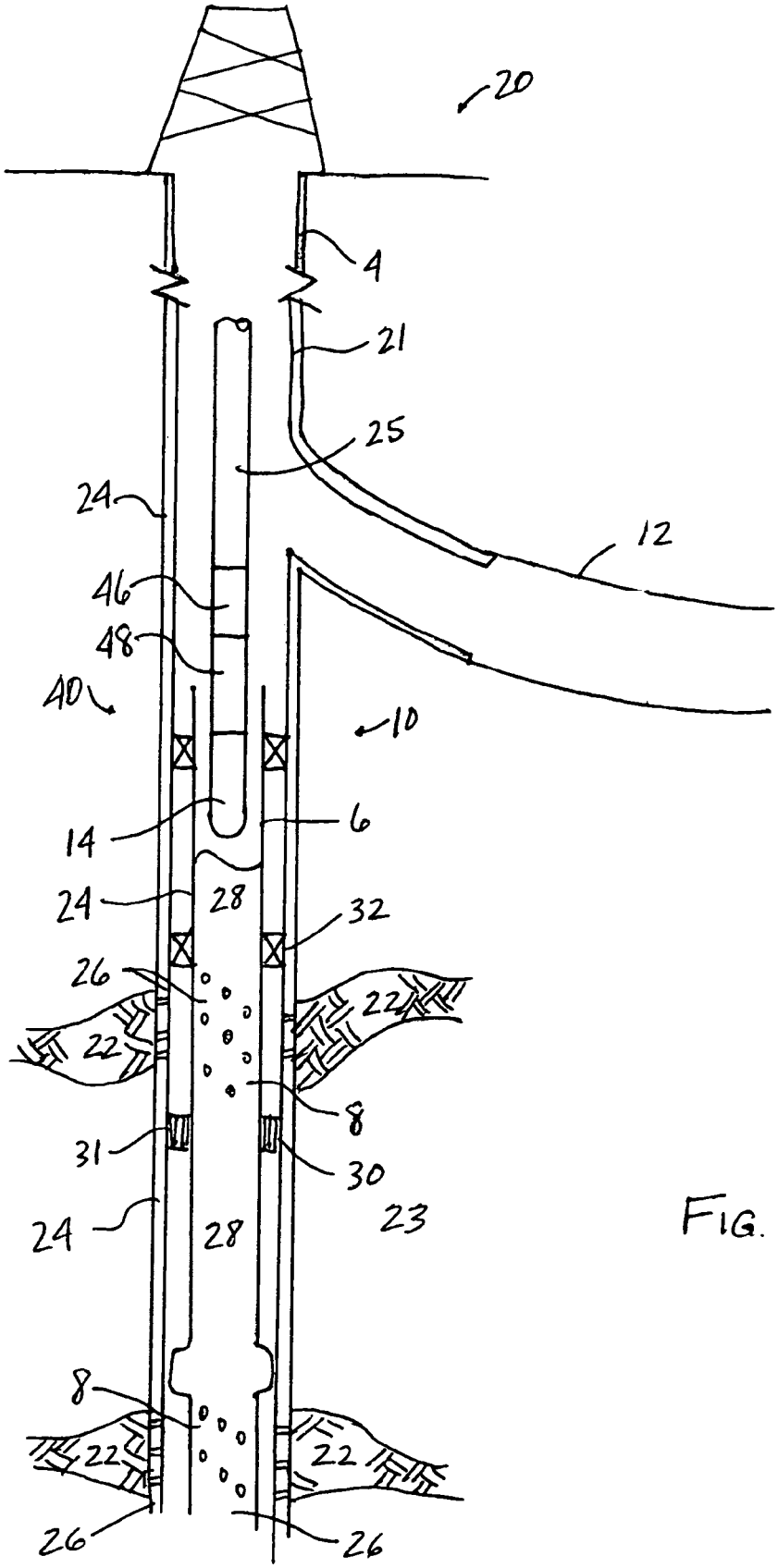
FIG. 1 is a schematic diagram of a typical deviated wellbore.

The present inventions are described by reference to drawings showing one or more examples of how the inventions can be made and used. In these drawings, reference characters are used throughout the several views to indicate like or corresponding parts. In the description which follows, like or corresponding parts may be marked throughout the specification and drawings with the same reference numerals, respectively. The drawings are not necessarily to scale and the proportions of certain parts have been exaggerated to better illustrate details and features of the invention. In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. The term "sand-control" used herein means the exclusion of particles larger in cross-section than a chosen size, whether sand, gravel, mineral, soil, organic or other matter, or a combination thereof.

Apparatus and methods for constructing and deploying variable diameter expansion tools and cones and methods of tubular expansion are disclosed in U.S. Pat. No. 6,722,427, issued Apr. 20, 2004, to John Gano, et al., and U.S. Pat. No. 6,854,522, issued Feb. 15, 2005, to Michael Brezinski, et al., both of which are assigned to the assignee of this application and are incorporated herein in their entirety for all purposes by this reference.

Turning to FIG. 1, a variable-diameter expansion cone tool 10 is preferably run as part of a single trip expansion system 40 into a subterranean well 20 having at least one wellbore or borehole 21. The tool 10 can be used in primary or secondary bores and can be used in vertical, deviated or horizontal bores. The variable-diameter expansion cone tool 10 is run-in as part of a work or tubing string 25. The work string 25 is made up of multiple tubing sections, joints, downhole tools, etc., and is run-in to the wellbore 21, which may be cased along its length or a portion thereof. The variable-diameter expansion cone tool 10 is used to radially expand selected sections of expandable tubulars and devices, such as expandable screen assembly sections 8, expandable blank sections or expandable casing 4 and any other expandable components. FIG. 1 shows the tool 10 in a top-down orientation, although this can be reversed, if desired. The variable-diameter cone tool 10 is run-in to the bore in a contracted position 42 to avoid hanging up in the wellbore.

Figure 2:
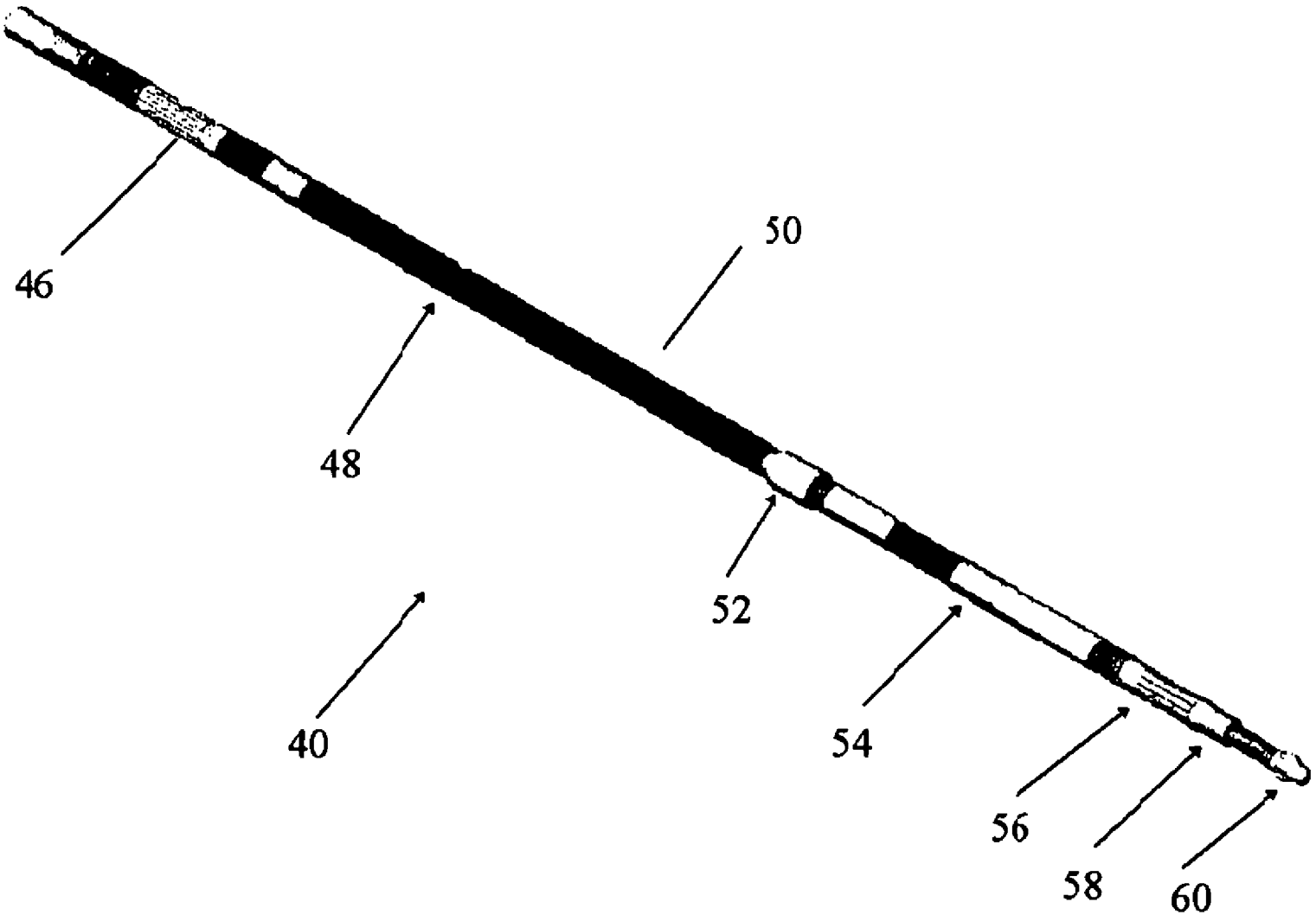
FIG. 2 is an orthogonal view of a single-trip expansion system, including the variable-diameter expansion tool.

In a preferred embodiment, the single trip expansion system 40, one embodiment of which is seen in FIG. 2, includes an anchoring device 46, which can include slips 46 or other anchoring devices known in the art. The anchoring device 46 is preferably designed to radially expand into gripping contact with the casing, uncased wellbore or other tubular, and acts to anchor the system such that the expansion tool 10 can be advanced along the tubulars. The anchoring device can be of any kind known in the art, but is preferably a slip system operated by pressure created by fluid flow pumped into the work string from the surface. Although the system is designed to save time and expense by providing for expansion of several expandable tubulars, which may be separated by restricted sections not desired to be expanded, the tool 10 and system 40 can also be used as a multiple trip device.

The variable-diameter expansion cone tool 10 must be forced, that is, pushed or pulled, along the tubular sections by a power supply assembly 48. The power supply assembly 48 is preferably a downhole power supply assembly which can be run-in to the hole on the same work string as the expansion tool 10, as shown. The power supply can be simply the weight of the work string. The power supply assembly 48 can include downhole motors, pumps, compressed gas chambers and other power sources known in the industry, but preferably the power supply assembly 48 is a stroking piston assembly 50 which is operated by fluid flow from the surface. That is, the stroking piston assembly 50 is itself powered by pumping fluid from the surface down through or along the work string 25. As the fluid is pumped down into work string and into the stroking piston assembly, the pressure created by the fluid flow works to activate the stroking piston assembly. Stroking piston assemblies are known in the art and will not be discussed in detail here.

In practice, the anchoring device 46, such as slips, is activated to engage the wellbore or tubular to anchor the expansion system during the expansion process. The power supply assembly 48 operates to force the expansion tool 10 along the wellbore, selectively expanding components as it moves. When the pistons of the power supply assembly have been longitudinally extended and the assembly has reached its furthest extent, the anchoring device is radially retracted, freeing the upper end of the expansion system, and the pistons of the power assembly are contracted. As the pistons are contracted, the expansion system 40 is dragged forward since the forward end of the tool 10 is "stuck" in the tubular or hole. The process is repeated as desired, thereby inchworming the system along the well. The power assembly 48 is powered hydraulically by a flow of fluid down the tool string. Such devices are known in the art and will not be discussed in detail here. For pipe that is substantially solid, except for apertures such as perforations, a power section such as the hydraulically operated device described above is required. Typically these aperture patterns remove less than 10% of the pipe wall. Typically hydraulic power is the only method available to generate enough force to expand near solid pipe. Alternately, the tool 10 can be advanced by other methods or tools, such as by rotating, pulling or pushing the work string along the wellbore, whether powered hydraulically, electrically or mechanically forced along the bore. The power supply device required is dependant on the type of pipe to be expanded. If the pipe is highly slotted, the downward force required to expand the components can be provided by slack-off weight from the work string. Another possible method for expanding highly slotted pipe employs a tractor device.

Figure 3:
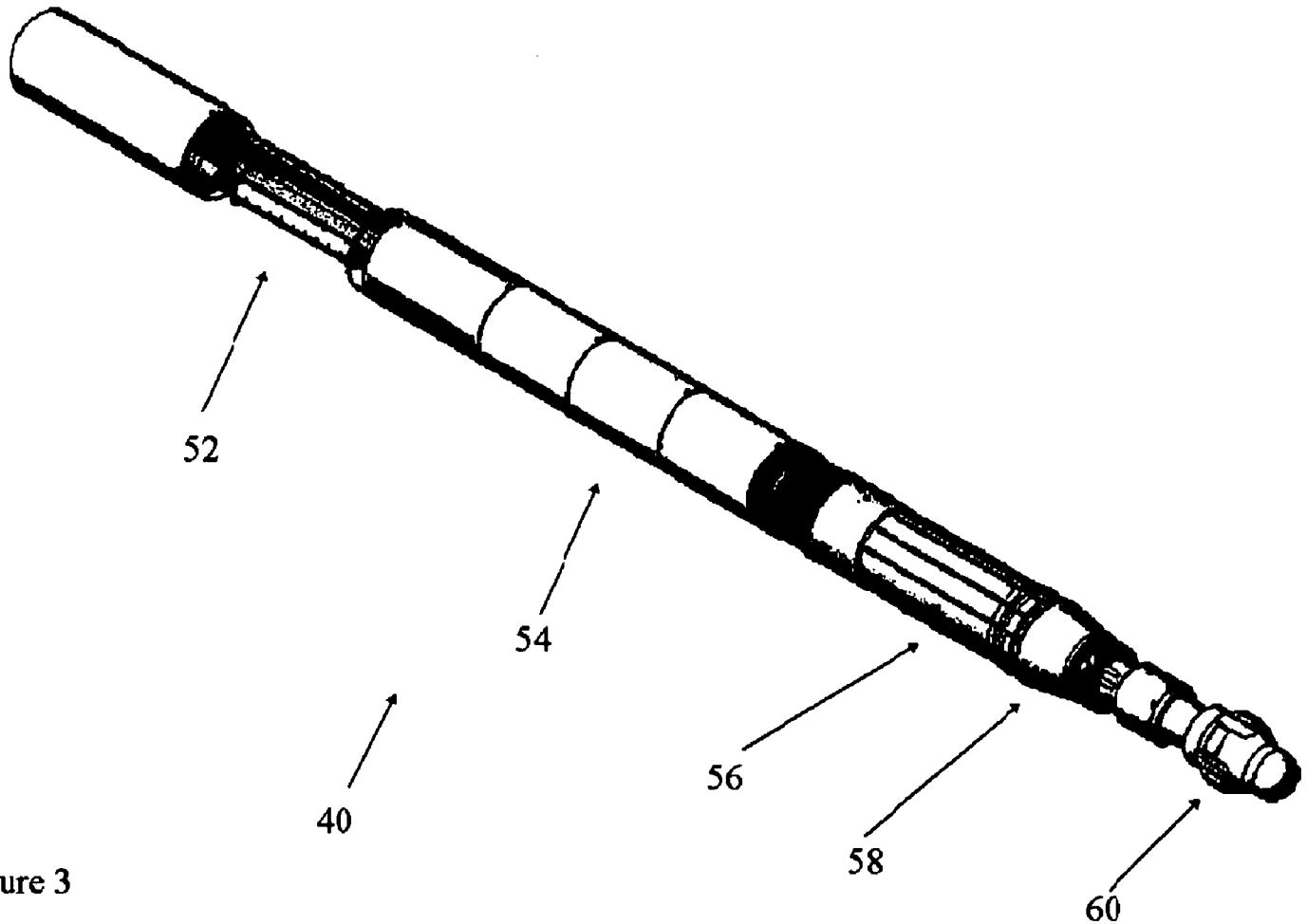
FIG. 3 is an orthogonal view, with cut-away, of the variable-diameter expansion tool.

Seen in FIGS. 2 and 3, at the lower end of the expansion system 40 is located the variable-diameter expansion cone tool 10, including a control section 52, variable-diameter cone piston section 54, variable-diameter cone section 56, fixed-diameter cone section 58 and forward end section 60. The work string 25 is attached to the upper end of the tool 10, and can include a power supply assembly, anchoring assembly and other tubing and devices as desired. In use, a preferably constant fluid flow rate, supplied from the surface, enters the variable-diameter expansion cone tool 10 from the work string to operate the tool. A pressure drop is created through an orifice in the control section 52 that will operate the variable-diameter cone piston section 54. The variable-diameter cone piston section 54 operates to radially enlarge or expand the variable-diameter expansion cone to a pre-selected diameter. As pressure increases, the stroking pistons of the power supply assembly 48 will advance the cone section of the expansion tool which will expand the expandable tubular components.

Figure 4:
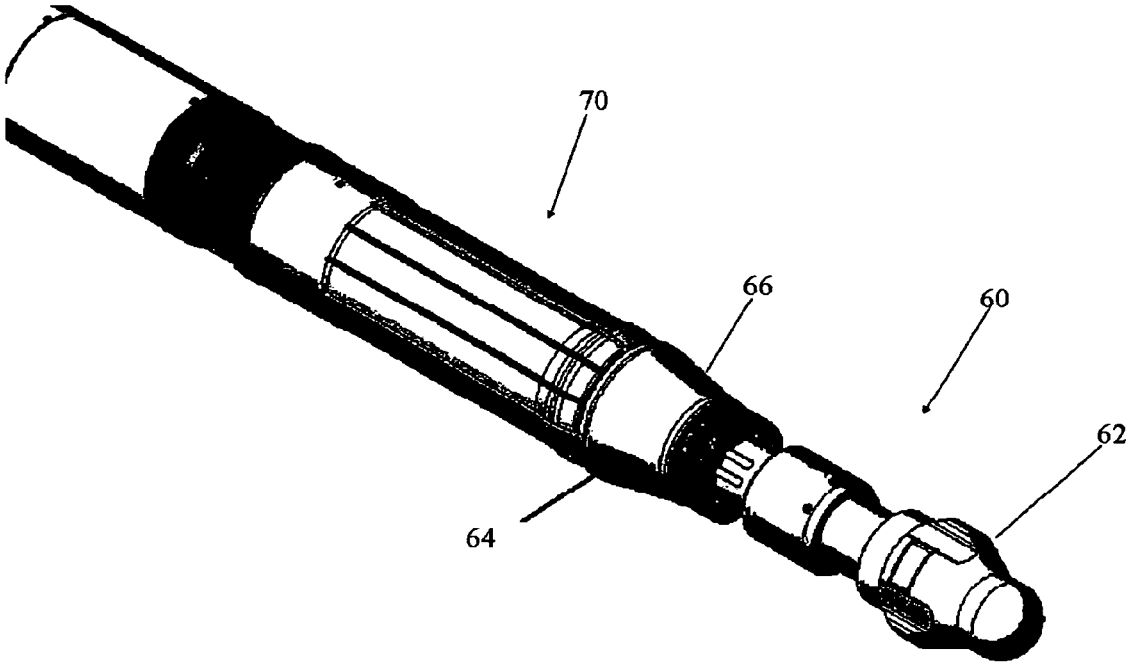
FIG. 4 is an enlarged partial view of the variable-diameter expansion tool.

FIG. 4 shows a close-up of the variable-diameter expansion cone tool 10. The forward end section 60 preferably includes a centralizer 62. The centralizer 62 acts to assist in maintaining the tool's lateral position within the tubular components. The centralizer may be of particular assistance in bent, differentially stuck, deviated or horizontal tubular components. The centralizer may be of particular assistance in bent, deviated or horizontal tubular components. This can be of particular assistance if the expandable pipe is differentially stuck to the open-hole wellbore. If the expansion cone is not centralized, the cone will tend to expand through the pipe wall opposite of the side that is differentially stuck to the wellbore. Therefore, the centralizer will help prevent the cone from expanding through the wall of the pipe.

The fixed-diameter cone section 58 of the tool 10 includes a fixed-diameter cone 64 that initially expands the expandable components. The fixed-diameter cone 64 is of a preselected size, such as having an outer diameter of 7.85 inches, based on the size of the expandable components. The diameter of the fixed-diameter cone can be of any desired size. The diameter of the fixed-diameter cone can be selected to be smaller than the non-expandable tubular components in a selected wellbore, such that the fixed-diameter cone will pass through these tubulars. The fixed-diameter cone 64 size is preferably selected to expand tubular components at least partially prior to further expansion, where desired and possible, by the variable-diameter cone 68. The outer surface 66 of the fixed-diameter cone is shown as conical and smooth, but the surface may have flat faces or be of another shape, as desired. The surface may also be grooved or slotted to allow for fluid flow past the exterior 66 of the cone 64. The fixed-diameter cone 64 is preferably fixed in diameter, that is, has only a single position, however, the fixed-diameter cone may be movable between a run-in and a radially expanded operating position. The fixed-diameter cone 64 is not designed to fluctuate appreciably in size during use expanding tubular components. The fixed-diameter cone is preferably employed on the tool 10 to reduce the expansion load that must otherwise be carried by the variable-diameter cone expansion section. However, the fixed-diameter cone section may not be necessary to enlarge expandable components. As will be explained herein, the fixed-diameter cone 64 is preferably movable and acts as an indicator of whether the expansion tool 10 is in an area of an expandable component or at an area with a larger diameter bore which does not need to be expanded.

Above the fixed-diameter cone section 58 is the variable-diameter cone section 56. The variable-diameter cone section 58 includes variable-diameter cone 68. The variable-diameter cone 68 is designed to be infinitely variable between a run-in position 70 and a fully-extended, radially expanded position 72. In the run-in position 70, the variable-diameter expansion cone 68 may be of the same size, at its widest point, as the fixed-diameter cone 64. For example, where the fixed-diameter cone 64 is 7.85 inches in diameter, the variable-diameter cone 68 would also be 7.85 inches in diameter, at its largest cross-section. Alternately, the variable-diameter cone 68 can be of a smaller or larger diameter, in the run-in position 70, than the fixed-diameter cone 64. The variable-diameter cone 68 is preferably designed to radially expand to a maximum diameter selected to produce expanded components of the desired size. In the same example, the variable-diameter cone 68 is preferably designed to radially expand an expandable component to an outer diameter of 8.00 to 8.75 inches. In this example, the variable-diameter cone 68 is designed to be smaller in outer diameter than the smallest inner diameter of any section of tubular or restriction which is not to be expanded. For example, if a seal bore, or other tubular component which is not to be expanded, has an inner diameter of 7.2 inches, the variable-diameter cone 68 is designed to have an outer diameter of 7.1 inches in the run-in position, at a maximum. That is, in the run-in position 70, the variable-diameter expansion cone 68 will pass through the restriction without expanding the narrow component. The particular diameter measurements may be selected as desired for any particular wellbore and tubular system.

The ability to "slide" the expansion tool through seal bores (and the like) without trying to expand them is a tremendous advantage. This is advantageous when a completion string is run inside of the expanded string for the purposes of producing from different zones throughout the length of the expanded tool string. A non-expanded seal bore in the "expandable" tool string allows for a seal unit to be placed to provide for isolation between zones. In many cases, the completion string will include control lines and electrical feed-throughs that are used to communicate and control the various components in the completion string. For example, internal control valves are often operated by control lines. To operate internal control valves, a hydraulic control line must be run along the length of the completion string. Therefore, the packer or seal bore must be able to accommodate the passage of these control lines. Because a packer includes components such as hydraulic pistons, slips, and thick sealing elements, it is more difficult to make room for these control lines to pass through it. A seal unit for use in a seal bore can be designed to allow for passage of the control lines more easily than a packer. A larger inner diameter through a seal unit can typically be attained as compared to a packer. This is important to reduce hydraulic friction when producing across a long horizontal interval (1,000 meters or more).

The variable-diameter cone 68 is generally conical in shape, although it can have grooves, slots, flat surfaces and other features or shapes, as desired. A preferred embodiment employs a collets-finger design having a plurality of collet fingers 74, which preferably extend downwards, and which are radially expanded at their forward ends to enlarge the effective diameter of the variable-diameter cone 68. The fingers of the preferred design may be hinged to provide ease of movement. Alternately, interlocking cone segments, connected together with dove tail grooves may be employed. The cone can alternately be made of segments or keys that are radially expanded. Further, they can be expanded with the hydraulic piston acting directly on the segments. Also, the cone segments can use tapered sides and when the segments are forced together they overlap. Those skilled in the art will recognize that other expandable cone designs may be employed.

Figure 5A:
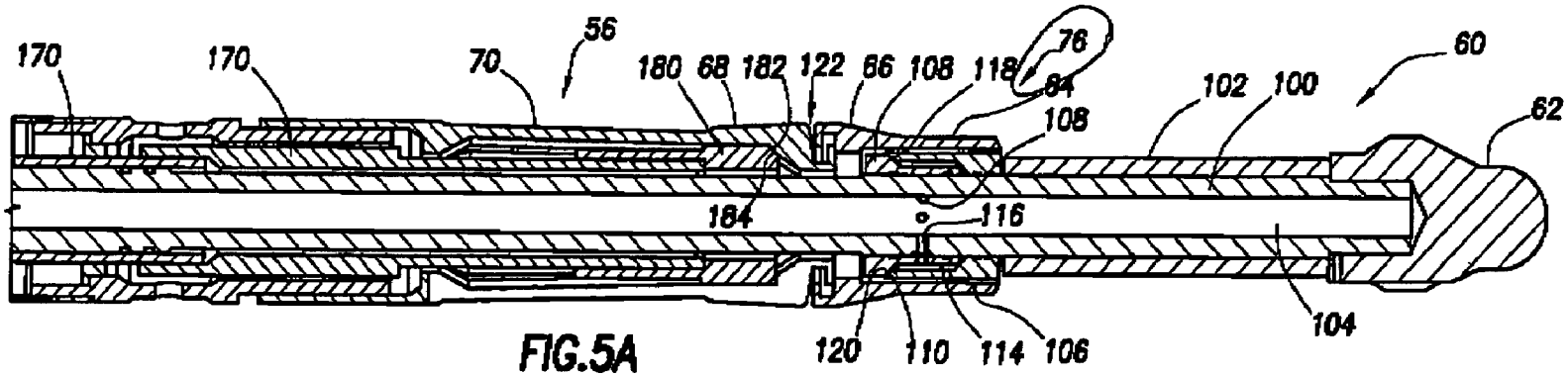
FIGS. 5A–C are cross-sectional views of the tool in the run-in position.
Figure 6A:
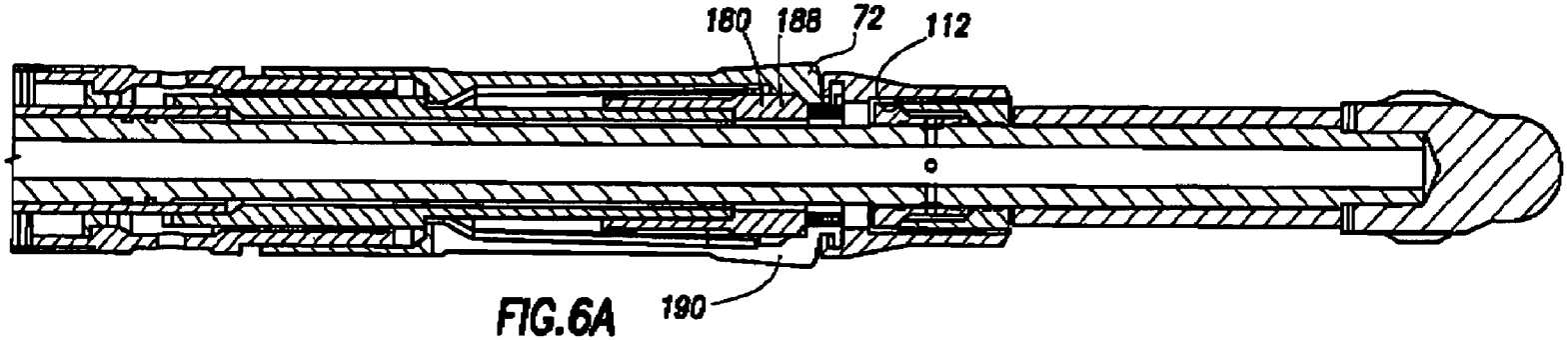
FIGS. 6A–C are cross-sectional views of the tool in an expanded position.
Figure 7A:
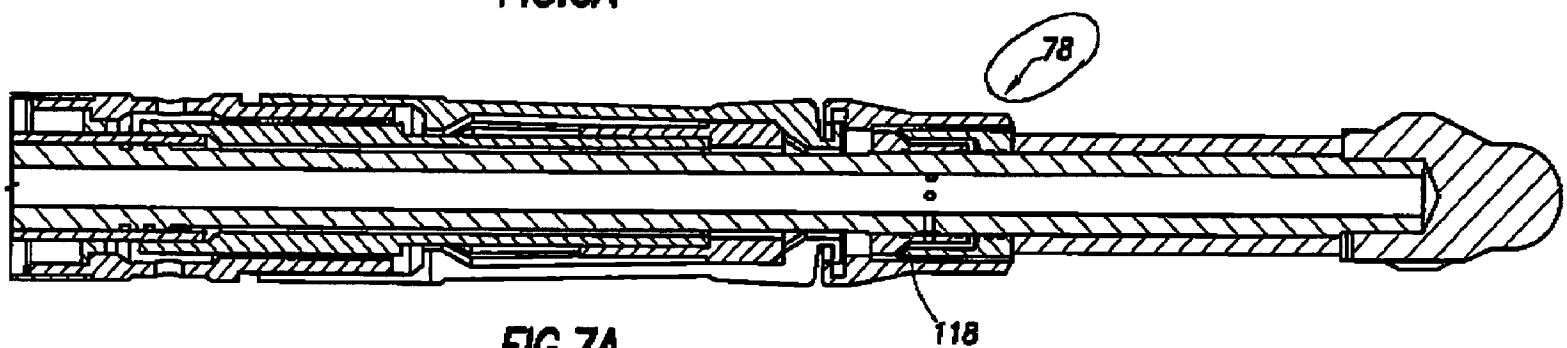
FIGS. 7A–C are cross-sectional views of the tool in a retracted position with the fixed-diameter cone unseated.
Figure 5B:
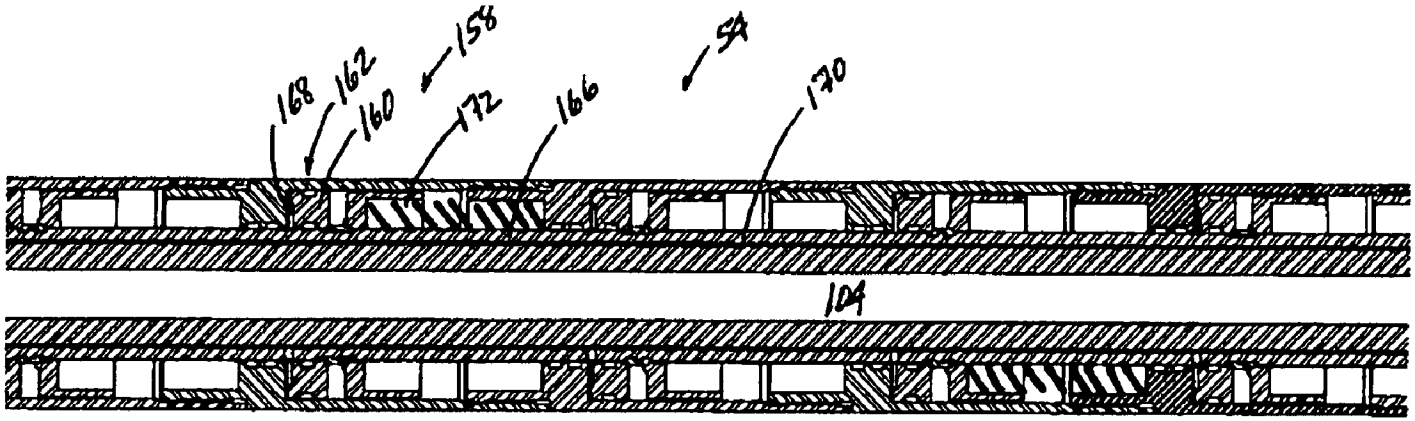
Figure 6B:
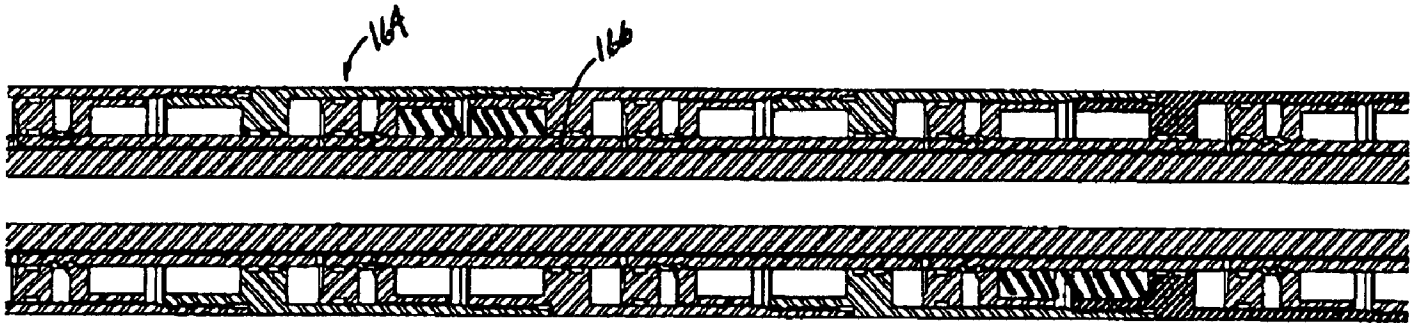
Figure 7B:
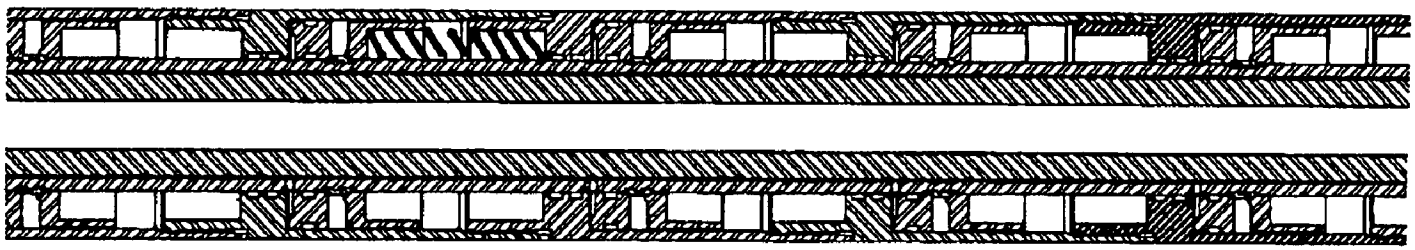
Figures 5C, 6C, 7C:
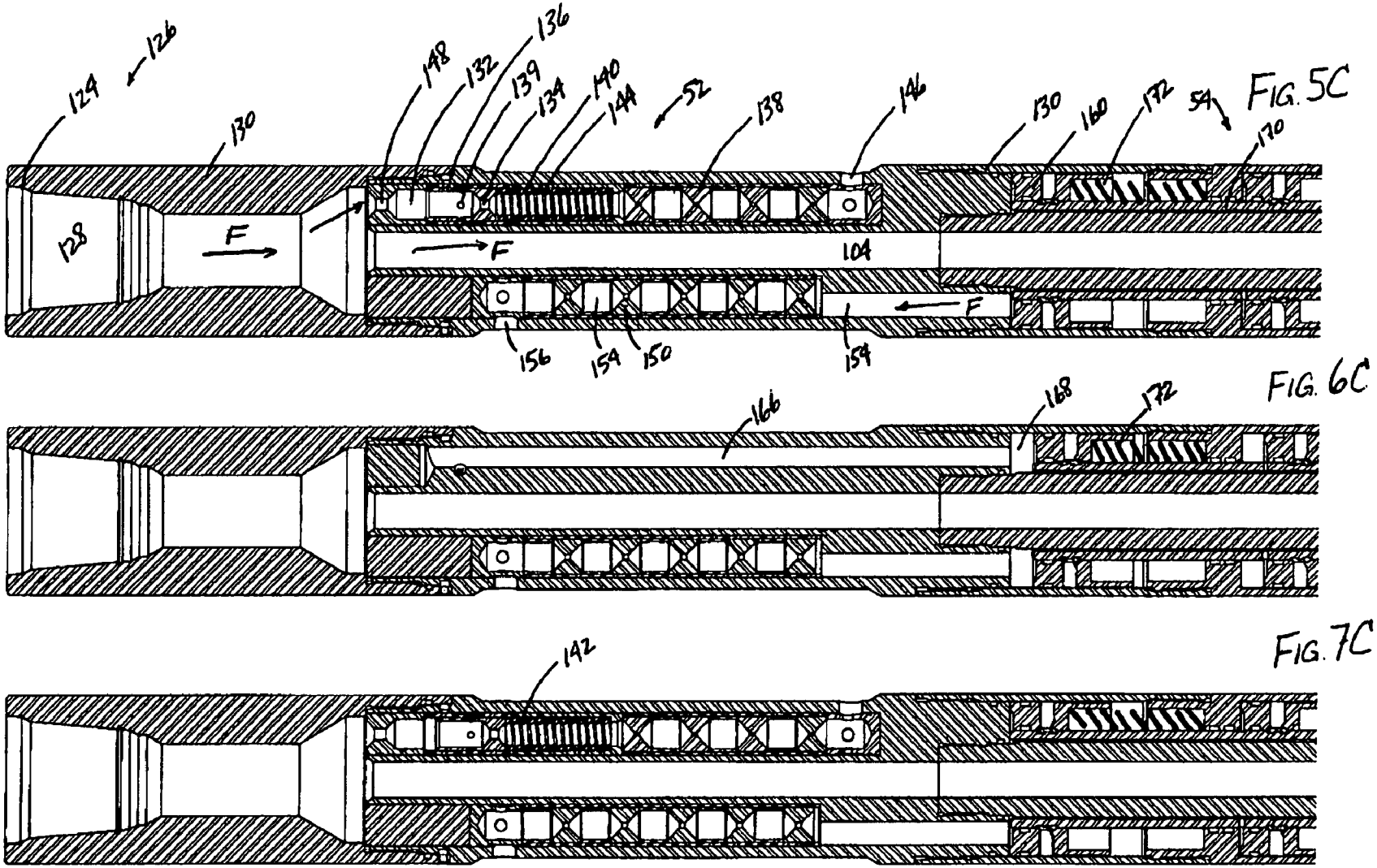

FIGS. 5A–C show a detailed schematic of the variable-diameter expansion cone tool 10 in a run-in, or retracted, position 70. FIGS. 6A–C show the same tool 10 in an expanded position 72. The fixed-diameter cone 64 is in the seated position 76 in FIGS. 5 and 6. FIGS. 7A–C show the same tool 10 with the variable-diameter expansion cone 68 in the retracted position 72 and the fixed-diameter cone 64 in an unseated position.

The forward end section 60 of the variable-diameter expansion cone tool 10 preferably includes a centralizer 62. The centralizer 62 acts to assist in maintaining the tool's lateral position within the tubular components. The centralizer may be of particular assistance in bent, differentially stuck, deviated or horizontal tubular components. The forward end section of the tool may include other components as desired, and is designed to lead the tool into the tubular components to be expanded. The forward section 60 preferably also includes portions of the inner mandrel 100 and a forward sleeve 102. The inner mandrel 100 defines an interior passage 104.

The fixed-diameter expansion cone section 58 includes a fixed-diameter expansion cone 64. As explained above, the fixed-diameter cone 64 has an exterior cone surface 66 for engaging and expanding an expandable component to an initially expanded size. The fixed-diameter cone surface 66 is preferably conical and continuous, but may be grooved, slotted, segmented or have flat or other shaped faces, as desired. The fixed-diameter cone 64 preferably allows fluid passage past the cone 64 as the cone expands an expandable component as it is advanced along the component to prevent excessive pressure build-up below the tool. In one preferred embodiment, bypass passages 106 are provided for this purpose. Alternately, grooves or other devices in the cone 64 may be used. The maximum diameter of the fixed-diameter cone 64 is selected to provide an initial expansion to an expandable component.

The fixed-diameter cone 64 is preferably mounted on the exterior of the inner mandrel 100. Throughout, where one component or part is mounted on or about another component, the components may be directly attached to one another or separated by one or more sleeves or other parts, as desired, unless otherwise specified. The fixed-diameter cone 64 can be fixedly attached to the inner mandrel 100, but is preferably slidably or movably mounted to the mandrel.

In a preferred embodiment, the fixed-diameter cone also acts as a contact indicator for the user, indicating when the tool 10 encounters an enlarged bore section, such as a pre-expanded tubular, bore seal, or other component not desired to be expanded. In such an embodiment, the fixed-diameter cone 64 is movable between a seated position 76, seen in FIG. 5A, and an unseated position 78, as seen in FIG. 7A. When the tool 10 is expanding an expandable component, the surface 66 of the fixed-diameter cone 64 will be in contact with the interior surface of the expandable component. The force of the contact on the fixed-diameter cone 64 will maintain the cone 64 in its seated position 76 wherein the cone 64 interacts with the fixed-diameter cone brace 108. Brace 108 limits upward movement of the cone 64 as inner shoulder 110 of the fixed-diameter cone 64 contacts outer shoulder 112 of the brace 108 when the cone 64 is in the seated position 76.

An annular space 114 is defined between the cone brace 108 and fixed-diameter cone 64. The annular space 114 is in fluid communication through port 116 with the interior passage 104 of the inner mandrel 100. As will be explained, the interior passage 104 of the inner mandrel 100 is supplied with fluid flow F from above. Fluid F is pumped or otherwise supplied at approximately a constant rate down the tool string and into the interior passage 104. When the fixed-diameter cone 64 is in its unseated position 78, fluid F flows through an indicator valve 118 and vents to exterior the tool 10. The indicator valve 118 is preferably a metal-to-metal seal 120, but may utilize other seals as are known in the art. In a preferred embodiment, the indicator valve or opening 118 is sealed by contact between the inner shoulder 110 of the cone 64 and the outer shoulder of the brace 108.

Upon entering a pre-expanded section of tubing, or a tubular with a larger diameter than the maximum diameter of the fixed-diameter cone, such as a seal bore, the fixed-diameter cone will move forward and unseat, or move-off its seat, allowing fluid F to flow through indicator valve or opening 118 and vent to exterior the tool 10. Forward motion of the cone 64 is limited by the forward sleeve 102. Since the fluid F is free to flow from the interior passage 104 to the exterior of the tool 10, a corresponding pressure drop will be seen at the surface by the user. This indication will allow the pump operator to reduce or stop applying the pump pressure while the expansion system 40 is moved past the larger diameter section. When another narrow component is encountered, the component will engage the surface 66 of the fixed-diameter cone 64, forcing the cone 64 to slide upwards to its seated position 76. The operator can set weight down against the unexpanded pipe. When flow is established a corresponding pressure increase will be seen by the operator at the surface, indicating that the tool is once again in contact with a component to be expanded.

Practitioners will recognize that the fluid communication between the fluid supply and into the annular space 114 may provided by other arrangements, such as through a communication passage between the annular space 114 and the fluid passages of the variable-diameter cone pistons. The arrangement shown is one preferred embodiment, but other arrangements may be used.

The fixed-diameter cone 64 and the variable-diameter cone 68 are preferably interlocked, as at interlocking sections 122. The interlocking sections 122 can act as movement limiting devices for the cones, however, it is preferred that they not serve this function because of the large forces involved.

Moving to the upper end of the tool 10, seen in FIGS. 5–7C, the tool is provided with a coupling 124 at its upper end. The coupling 124 allows the tool 10 to be attached to a work string, preferably to a power supply assembly 48. The upper end 126 of the tool 10 defines a fluid passage 128 which receives fluid flow from the work string and the surface. The passage 128 is fluidly connected with interior passage 104 of the interior mandrel 100.

The control section 52 of the tool 10 is seen in FIGS. 5–7C. The control section 52 includes portions of interior mandrel 100 and exterior mandrel 130. Defined between the portions of the interior and exterior mandrels is control passage 132. Disposed in the control passage 132 is control choke 134, control shuttle valve 136, and a series of main chokes 138. The control choke 134 regulates the maximum pressure into the cone piston section 54 and is selected to regulate the pressure to design specifications. The control valve 136 is preferably a shuttle valve, as shown, but can be another valve type as known in the art. The control valve 136 is movable between an open position 140, seen in FIG. 5C, and closed position 142 seen in FIG. 7C. The control valve is biased open by bias spring 144. The control shuttle valve 136 includes ports 139 which allow fluid communication between the control passage 132 and, using flow channel 166, the piston section 54 when the control valve is in the open position 140. When in the closed position 142, flow to the piston section is prevented. As practitioners in the art will understand, the shuttle valve 136 can employ a machined outer diameter, or the port 139 may be shaped, to allow for a progressive closure of flow to the piston section through ports 139. In use, fluid flow F from the work string is provided to control passage 132 and into control valve 136.

Downstream from the control valve 136 is a series of main chokes 138 which provide further pressure drops as fluid flows through the main chokes. The main chokes 138 are fluidly connected to the exterior of the tool 10 by vent 146. In use, the fluid passage from the fluid string through the control choke and valve and into the main chokes and to the vent 146 always remains open. The main chokes 138 are preferably a series of chokes, which are less likely to plug, reduce the pressure differential needed across the control choke, allow use of a smaller bias spring 144 and are easier to dampen. Alternately a single main choke could be provided.

An optional choke ring 148 is provided at the entrance to the control valve. The choke ring 148 is designed to reduce the kinetic energy of the fluid flowing into the control valve and to dampen possible vibrations of the valve and passage system.

The control section 52 also includes an exit passage 154 providing fluid communication from the piston section 54 to the exterior of the tool 10 through vent 156. A series of minor chokes 150 is preferably provided in the exit passage 154. This exhaust passage allows the pressure to reduce in piston section 54 when the valve is closed.

The cone piston section 54 of the tool 10 is seen across FIGS. 5A–C with the pistons 160 in their home positions 162, and across FIGS. 6A–C with the pistons 160 in their actuated positions 164. The pistons 160 are provided in series to provide enough total piston area to operate the variable-diameter expansion cone and to hold it in the expanded position while expanding an expandable component. In a preferred embodiment, six piston assemblies 158 are provided in series. In practice, the number of piston assemblies is a matter of design choice based on the limitations of space, the necessary piston force to operate the tool and other considerations. Fluid communication is provided to the piston assemblies 158 through ports 139 in the control valve 136 to communication passage 166. Communication passage 166 extends along the series of piston assemblies 158 providing fluid communication to the piston cylinders 168 corresponding to each piston 160. As fluid F increases the pressure on the pistons 160, they are forced forward as the cylinder areas 168 fill with fluid. The pistons 60 are operably connected to sliding sleeve 170 such that sleeve 170 is moved forward along with the pistons 160 when they are in the actuated position 164. Conversely, when the pistons 160 are moved back to the home position 162, the sleeve 170 is moved backward as well. Each piston assembly 158 includes a bias spring 172 which biases its corresponding piston 160 towards the home position 162.

For clarity, only a few of the bias springs 172 are shown. In practice, each piston assembly 158 has a corresponding bias spring 172.

The variable-diameter cone section 56 includes variable-diameter cone 68 which is radially expandable between a run-in position 70, seen in FIG. 5A, and an expanded position 72, seen in FIG. 6A. Preferably the cone 68 is infinitely variable between the two positions. A wedge 180 is movable under the variable-diameter cone 68, and operates to actuate the cone 68. The wedge 180 is connected to the sliding sleeve 170 which is moved by the piston assemblies 158. When the pistons are moved from their home positions 162 to their actuated positions 164, the sliding sleeve 170, in turn, is moved forward and the attached wedge 180 is slid forward as well. The wedge 180 has sloped wedge surfaces 182 which contact corresponding sloped surfaces 184 on the interior of the variable-diameter cone collet fingers 74. As the wedge 180 moves forward, the sloped faces 182 of the wedge slide forward under the corresponding interior cone surfaces 184 of the cone, thereby forcing the collet fingers 74 outward and expanding the variable-diameter cone 68. Wedge faces 182 and corresponding interior cone surfaces 184 are preferably flat, as opposed to conical, allowing the surfaces to slide along one another. The wedge 180 can be moved to an infinite number of positions between a home position 186, seen in FIG. 5A, and an actuated position 188, seen in FIG. 6A. Consequently, the variable-diameter cone 68 is infinitely variable between its retracted, run-in position 70 and its fully-expanded position 72.

The variable-diameter cone section 56 is preferably provided with bypass passages 190 to allow fluid flow past the variable-diameter cone as the expansion tool 10 is advanced along the wellbore. In a preferred embodiment, the spaces between the collet fingers of the variable-diameter expansion cone provide adequate bypass flow passages.

The fixed-diameter cone and variable-diameter cone are preferably designed to be directly adjacent to another. Such an arrangement reduces the amount of total cold-working induced into the expandable component. If the cones are separated, more cold-working is induced in the expanded component.

In use, the system works from pressure increases and decreases caused by a constant flow rate through the system provided by the operator from the surface. The tool 10 is run-in to the hole in its run-in position. Once located where desired, fluid is pumped into the work string at a more or less constant rate, such as two barrels per minute, for example. The fluid is pumped down the work string and is used to actuate the power supply assembly 48. The fluid flow F operates the power supply assembly 48 which drives the expansion tool 10 forward through the wellbore. The power supply assembly 48, which preferably includes a series of piston assemblies, must supply enough force to advance the cone assembly through expandable components with enough force to expand the components. The fixed-diameter cone 64, which is in its seated position 76, engages expandable components as the tool 10 is forced forward through the wellbore, thereby expanding the expandable components.

A portion of the fluid flow from the surface is directed into the upper end passage 128 of the variable-diameter expansion cone tool 10. The fluid is directed into the mandrel passage 104 and into the control passage 132 of the control section 52. As the fluid enters the control section 52 it is split at the control shuttle valve 136. Some fluid flow F passes through the control valve and a pressure drop is created across a reduced diameter orifice or choke 134. This fluid flow is then directed out of the tool 10 through main choke series 138 and vent 146. The fluid flow can optionally be directed through a choke ring 148 to reduce kinetic energy and dampen potential vibrations.

The remaining fluid flow F passes through a separate port 139 of the control valve 136 that supplies pressure to the variable-diameter cone piston section 54 to drive the cone piston assemblies 158. Fluid is directed through the port 139 into the communication passage 166 of the piston section 54. The communication passage supplies fluid pressure to a series of piston assemblies 158, in the illustrated embodiment six piston assemblies. The fluid flow fills the cylinders 168 forcing pistons 160 forward. The pistons 160 are attached to sliding sleeve 170, which is driven forward by the pistons. The sliding sleeve 170 is connected to the wedge 180 of the variable-diameter cone 68 of section 56. The wedge 180 is driven forward under the collet fingers 74 of the variable-diameter expansion cone 68, thereby expanding the collet fingers and the cone 68 into its expanded position 72. In its expanded condition 72, the variable-diameter expansion cone 68 expands any expandable components encountered as the tool 10 is driven forward through the wellbore. Return flow from the piston assemblies is routed through the exit passage 154 and minor orifice or choke series 150 at all times.

When the variable-diameter expansion cone encounters a restriction in the wellbore, the expansion tool 10 will slow down or stop stroking. Similarly, the stroking piston assembly 50 of the power supply assembly 48 will stop stroking and moving forward. This will cause an increased fluid flow rate through the control valve 136 and a corresponding increase in the pressure drop across the control valve 136. The control valve 136 is biased toward the open position 140 by bias spring 144. The control valve and bias spring are selected to move to the closed position 142 when the pressure on the valve reaches a predetermined value. The valve 136 then shuts ports 139 and cuts-off flow to the cone piston section 54. The pressure in the communication passage 166 and piston assemblies 158 drops as fluid is vented through the exit passage 154 and minor choke series 150 to the vent 156. The piston assemblies 158, consequently, will retract to their home positions 162. The pistons are biased towards their home positions by bias springs 172. Additionally, the pistons will tend toward their home positions due to the force of the pressure on the exterior of the variable-diameter cone. As the pistons retract, the variable-diameter cone 68 also retracts towards its run-in position. Further, due to the increased flow rate through the main choke series 138, the fluid pressure to the stroking piston assemblies 50 of the power supply assembly increases.

Once the variable-diameter cone 68 has retracted enough to reduce the pressure on the cone 68 enough to allow continued forward movement of the tool 10, movement commences again. As the expansion continues and the tool increases speed, the pressure on the control valve is reduced, the valve moves to its open position and fluid flow is restored to the piston assemblies 158 again. The process will oscillate as needed to retract the variable-diameter expansion cone enough to allow forward movement of the tool 10. The infinitely variable-diameter cone 68 automatically expands and retracts based on the resistance offered by the expandable components. The variable-diameter cone will provide maximum expansion where resistance is normal, but will contract to a size small enough to allow continued forward movement and allowable expansion of the components where increased resistance is met at restrictions or upsets. Once the expansion tool passes the restriction the variable-diameter cone will increase in diameter again and continue expansion as normal. In extreme cases, the variable-diameter cone will contract to its run-in position and the tool will advance expanding tubulars and components only with the fixed-diameter cone.

The tool automatically senses variable pressure on the expansion cone, in effect sensing the radial load on the cone indirectly. The tool senses pressure, and the pressure is directly affected by the expansion force needed by the power section. As the pressure on the cone increases, the tool automatically reduces the diameter of the variable-diameter cone until the radial pressure is reduced. The radial force is only regulated by pressure in passage 166 which is controlled by the shuttle valve enough to allow continued forward motion and expansion. It is apparent that there are some conditions where the power section will not be sufficiently powerful to continue expansion. This can be limited by the strength of the pipe being expanded. As the pressure decreases below shuttle valve set pressure the valve opens and the variable-diameter cone expands to a maximum diameter and expands the expandable components to the full desired extent.

Where the expansion tool 10 progresses into an area of components which have a larger diameter than the variable-diameter expansion cone, the cone will not contact any component. This may occur by design at seal bores or pre-expanded areas or anywhere expansion is not needed. At these locations, no force will act on the fixed-diameter cone 64. Consequently, the fixed-diameter cone 64 will move from its seated position 76 to its unseated position 78. This unseating, or movement of the fixed-diameter cone forwards, will open the indicator valve 118 and allow fluid flow from the inner passage 104 of the mandrel 100, through the opening and to the exterior of the tool 10. This will produce a drastic pressure drop in the system which will act as an indicator to the user that expansion is not occurring and is not needed at that section of the wellbore. The operator can then reduce the fluid flow while the tool is advanced. When an expandable component is encountered again, the component will act upon the fixed-diameter cone, forcing it to reseat, and the load increase against the bore acts as an indicator to start the pumps again.

Figure 8:
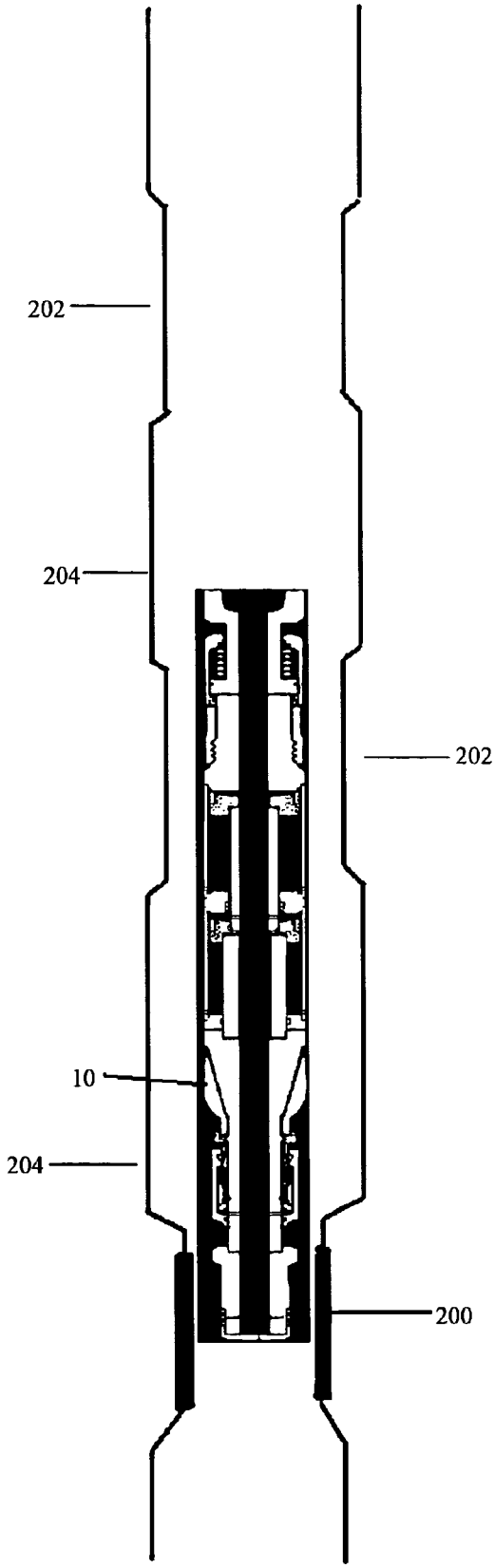
FIG. 8 is a schematic of the tool of the invention passing along a section of wellbore.

FIG. 8 shows the variable-diameter expansion tool 10, with the variable-diameter cone retracted to its run-in position, advancing through a section of wellbore. The expansion tool outer diameter is small enough to allow the tool to pass through an area not requiring expansion 200, such a seal bore. The tool 10 has already expanded the wellbore tubulars to varying degrees depending on the resistance offered. The tool has automatically reduced in diameter at restrictions 202 and enlarged to its completely expanded position to completely expand the components at normal areas 204.

The embodiments shown and described above are only exemplary. Many details are often found in the art such as screen or expansion cone configurations and materials. Therefore, many such details are neither shown nor described. It is not claimed that all of the details, parts, elements, or steps described and shown were invented herein. Even though, numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. An apparatus for radially expanding a tubular positioned downhole in a subterranean wellbore, the apparatus comprising:

a tool body;

a variable-diameter cone mounted on the tool body for expanding the tubular, the variable-diameter cone variable between a retracted position wherein the cone is of a size to pass through the tubular without expanding the tubular and a fully expanded position wherein the variable-diameter cone is operable to expand the tubular to a fully expanded diameter;

the tubular offering a resistance to the variable-diameter cone during expansion of the tubular;

the variable-diameter cone operable to automatically vary in diameter based on the resistance offered by the tubular during expansion, the variable-diameter cone operable to radially expand the tubular to less than the fully expanded diameter.

2. The apparatus as in claim 1 wherein the variable-diameter cone is designed to exert a pre-selected force on the tubular when expanding the tubular, the variable-diameter cone operable to expand the tubular to substantially the maximum diameter possible, up to the fully expanded diameter, by exerting the pre-selected force.

3. The apparatus of claim 2 wherein the variable diameter cone is infinitely variable between the run-in and fully expanded positions and operable to expand the tubular at infinitely variable positions.

4. The apparatus as in claim 1 wherein the variable-diameter cone is operable to fully expand the tubular where the tubular offers less than a pre-selected resistance, the variable-diameter cone operable to expand the tubular by exerting a pre-selected force on the tubular, the variable-diameter cone automatically retracting in diameter to expand the tubular to substantially the largest diameter possible utilizing the pre-selected force.

5. The apparatus of claim 1 wherein the variable-diameter cone expands the tubular in the fully expanded position when the tubular offers resistance below a pre-selected resistance.

6. The apparatus of claim 5 wherein the variable-diameter cone expands the tubular to less than the fully expanded diameter when the tubular offers greater than the pre-selected resistance.

7. The apparatus of claim 6 wherein the variable-diameter cone is infinitely variable between the run-in and fully expanded positions and operable to expand the tubular at infinitely variable positions.

8. The apparatus of claim 1 wherein the variable-diameter cone is infinitely variable between the run-in and fully expanded positions and operable to expand the tubular at infinitely variable positions.

9. The apparatus of claim 1, the apparatus further comprising a piston section, the piston section operable to expand the variable-diameter cone and to maintain the variable-diameter cone in variable expanded positions during expansion of the tubular.

10. The apparatus of claim 9 wherein the piston section is actuated by a substantially constant flow of fluid.

11. The apparatus of claim 10 wherein the piston section comprises at least one piston-cylinder assembly having a piston movable between an extended position and a retracted position, the assembly having an intake port for receiving fluid flow to move the piston towards the extended position, and the piston assembly having a vent for expelling fluid flow to retract the piston towards the retracted position.

12. The apparatus of claim 11 wherein the control section includes a control valve for regulating fluid flow to the piston section.

13. The apparatus of claim 10 further comprising a control section, the control section operable to automatically regulate fluid flow to the piston section.

14. The apparatus of claim 9 further comprising a wedge operable to actuate the variable-diameter expansion cone, the piston section operably connected to slidably move the wedge with respect to the variable-diameter cone thereby expanding or retracting the variable-diameter cone.

15. The apparatus of claim 1 wherein the variable-diameter cone comprises a plurality of collet-fingers, the collet-fingers radially expandable at one end.

16. The apparatus of claim 1 wherein the variable-diameter cone comprises radially expandable segments.

17. The apparatus of claim 1 further comprising a fixed-diameter expansion cone mounted on the tool body, the fixed-diameter cone operable to partially expand the tubular prior to expansion of the tubular by the variable-diameter expansion cone.

18. The apparatus of claim 17 wherein the fixed-diameter cone is movable between a run-in position and an expanded position.

19. The apparatus of claim 17 wherein the fixed-diameter cone acts as a contact indicator.

20. The apparatus of claim 19 wherein the fixed-diameter cone is slidably mounted to the tool body between a seated position when the fixed-diameter cone is in contact with the tubular, and an unseated position when the fixed-diameter cone is not in contact with the tubular.

21. The apparatus of claim 20 wherein the fixed-diameter cone further comprises a communication passage for receiving fluid flow from the interior of the tool body and a vent for expelling fluid to the exterior of the tool body, the vent closed when the fixed-diameter cone is in the seated position and the vent open when the fixed-diameter cone is in the unseated position.

* * * * *